United States Patent [19]

Sanders

[11] Patent Number: 4,794,669

[45] Date of Patent: Jan. 3, 1989

[54] ELASTOMERIC HINGE SPRING

[75] Inventor: Myron D. Sanders, Noblesville, Ind.

[73] Assignee: The Firestone Tire & Rubber Company, Akron, Ohio

[21] Appl. No.: 183,662

[22] Filed: Apr. 19, 1988

Related U.S. Application Data

[63] Continuation of Ser. No. 938,475, Dec. 5, 1986, abandoned.

[51] Int. Cl.[4] ..... E05D 11/10

[52] U.S. Cl. ..... 16/341; 16/344; 16/375

[58] Field of Search ..... 16/32, 86 A, 293, 296, 16/321, 332, 343, 344, 375, DIG. 32, DIG. 33, 341

[56] References Cited

U.S. PATENT DOCUMENTS

| | | | |
|---|---|---|---|
| 698,052 | 4/1902 | Place . | |
| 1,415,493 | 5/1922 | Strayer | 16/86 A |
| 2,236,026 | 3/1941 | Westcamp | 292/79 |
| 3,577,840 | 5/1971 | Buberniak . | |
| 4,240,179 | 12/1980 | Lautenschlager, Jr. | 16/321 |
| 4,472,857 | 9/1984 | Guiouie | 16/341 |

FOREIGN PATENT DOCUMENTS

| | | | |
|---|---|---|---|
| 558367 | 6/1958 | Canada . | |
| 2460864 | 7/1975 | Fed. Rep. of Germany | 16/375 |

*Primary Examiner*—Fred A. Silverberg
*Attorney, Agent, or Firm*—Ronald Brietkrenz

[57] ABSTRACT

An elastomeric hinge spring intended primarily for the doors of vehicles, has an outwardly projecting detent formed on a first bracket mounted on the vehicle frame and a roller formed of a compressible elastomeric material mounted on a second bracket attached to the vehicle door. The detent is in the path of movement followed by the roller upon movement of the second bracket and door toward the closed position. The roller retains the door in the open position requiring temporary compression of the roller to move of the door toward the closed position. The detent may have two projections which provide an intermediate door position or have an elongated ramp configuration to achieve other door opening and closing characteristics. Another detent may be formed on the first bracket to partially compress the roller when the door is in the closed position to bias the door toward the open position. The elastomeric roller completely eliminates metal spring components heretofore used in prior hinge spring devices.

6 Claims, 3 Drawing Sheets

ELASTOMERIC HINGE SPRING

This application is a continuation application of my copending application bearing Ser. No. 06/938,475, filed Dec. 5, 1986, now abandoned.

TECHNICAL FIELD

The invention relates to hinge springs, in particular for a pivotally mounted door of an automotive vehicle. More particularly, the invention relates to a hinge spring using an elastomeric compressible roller to retain the door in the open position eliminating all metal spring components heretofore required.

BACKGROUND ART

Nearly all vehicle doors having a hinge spring device or other mechanism which retains the door in the full open position until a force is applied thereto to overcome the biasing action of the spring or other mechanism in order to move the door toward the closed position. Nearly all of these hinges use a mechanism which typically consist of metal springs, plastic or metal rollers and detents, and notches in appropriate locations to provide a temporary holding of the door in the open position.

Another common design employs two flat metallic springs or leaf springs. However, such a design lacks spring rate consistency due to various manufacturing limitations and is subject to failure as well as other hinge springs using metal components, by stress cracks forming in the base of the spring where they are bolted or riveted to the vehicle door frame or door. Attempts have been made to eliminate such stress areas in these metallic springs by using a rubber spring pad as a helper spring to enable a lower rate metal spring to be used which is less susceptable to stress cracks. Although this design reduces much of the stress problem, it does not consistently possess the desired spring rate curve.

Another problem with existing hinge spring designs is that in order to control large doors of larger cars and trucks, it is difficult to provide sufficient door cavity sizes and hinge spring components in order to form the metal for the spring with sufficient strength to be able to withstand the forces and repetitions placed thereon.

Various other known prior art door hinge springs are shown in the following patents. U.S. Pat. No. 698,052 discloses a door guide attachment which is attached to the back of a door and has an anti-friction roller adapted to reduce the friction of the guide.

U.S. Pat. No. 2,236,026 discloses the use of a relatively large diameter roller bumper of resilient material in which the axis of the roller bumper is biased by a metal spring during closing of the door. Stop flanges resist movement of the resilient roller in the door closing operation. Although the bumper or roller can be formed of rubber, it must be held in engagement by a metal spring.

U.S. Pat. No. 3,577,840 discloses a self-holding hinge using a detent roller formed of nylon or other plastic or metal material in which the roller is forced over a pair of lips during the closing operation. During the hinge opening or closing, a metal spring is compressed to permit the roller to roll over the detents.

U.S. Pat. No. 4,472,857 discloses a stop device for use with vehicle doors in which a lower roller is spring biased by a helical metal spring against an upper roller, and an arm manufactured with a varying width is forced between the two rollers. The spring of the lower roller resists the insertion of the arm therebetween.

Canadian Pat. No. 558,367 disclosed another hinge device for oven doors which uses a roller which fits into the recess of a lever in a fully opened door position. The lever is resiliently spring biased by a metal spring with the roller being located in a fixed position.

Accordingly, the need has existed for an improved hinge spring construction which eliminates the need for any metallic spring components which will enable the door to move easily to an open position and yet to be retained therein until sufficient force is exerted thereon to move it toward the closed position, the amount of force being variable depending upon the vehicle construction in which the spring is installed.

DISCLOSURE OF THE INVENTION

Objectives of the invention include providing an improved elastomeric door hinge construction which uses a compressible elastomeric roller to retain a door primarily on a vehicle, in an open position and which can be designed by choosing different elastomeric materials and characteristics thereof, in addition to an engaged detent located and designed to achieve various closing and holding characteristics. A further objective is to provide such an improved hinge spring construction which completely eliminates the need for any metal spring and related components therefor, thereby providing a device having a longer life and less prone to damage and maintenance, and of a considerably simpler and less expensive construction than known hinge springs utilizing metal spring components.

A further objective is to provide such a hinge spring construction consisting of two metal stamped brackets, one of which has one or more detents stamped therein over which the roller must move and be temporarily compressed as the door moves from the open toward the closed position, in which the roller can be molded or shaped to achieve different door control characteristics, and in which the elastomeric roller is less effected by changes in temperature and road chemicals to which it is exposed than heretofore used metal spring components. Another objective is to provide such an improved hinge spring construction which requires less space to achieve the desired operating characteristics as prior metal hinge spring constructions and with a fewer moving parts; and in which the resulting spring is safe and more reliable than known hinge spring constructions.

These objectives and advantages are obtained by the improved hinge spring construction for use on a swinging door, the general nature of which may be stated as including a first bracket adapted to be mounted on a frame of a doorway; a second bracket adapted to be mounted on the door and movable between open and closed positions; an elastomeric roller mounted on the second bracket; and detent means formed on the first bracket projecting into the path of movement followed by the roller upon movement of the second bracket into closed position for retaining said second bracket in the open position and to require temporary compression of the roller upon movement of the second bracket from the open position toward the closed position.

BRIEF DESCRIPTION OF THE DRAWINGS

Preferred embodiments of the invention, illustrative of the best modes in which applicant has contemplated applying the principles, are set forth in the following description and are shown in the drawings, and are distinctly set forth and pointed out in the appended claims.

Similar numerals refer to similar parts throughout the drawings.

BEST MODES FOR CARRYING OUT THE INVENTION

Figure 1:
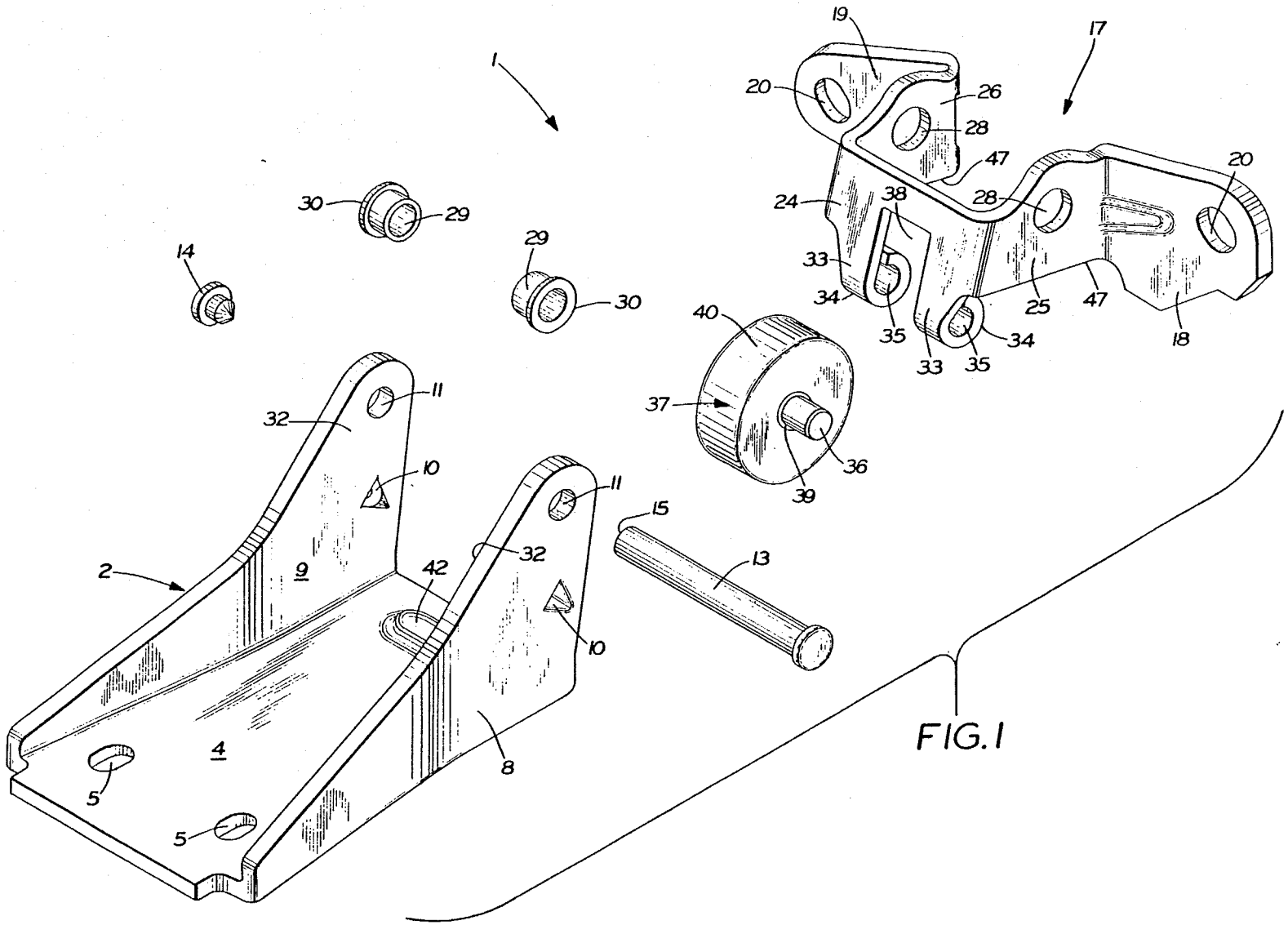
FIG. 1 is an exploded perspective view of the improved elastomeric hinge spring of the invention.
Figure 2:
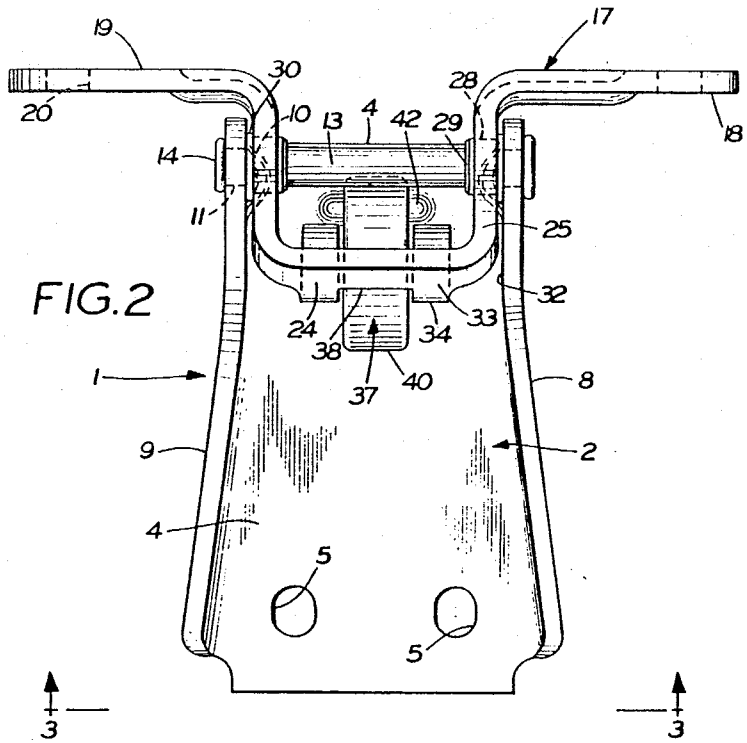
FIG. 2 is a top plan view of the hinge spring shown in FIG. 1 shown in assembled closed position.
Figure 3:
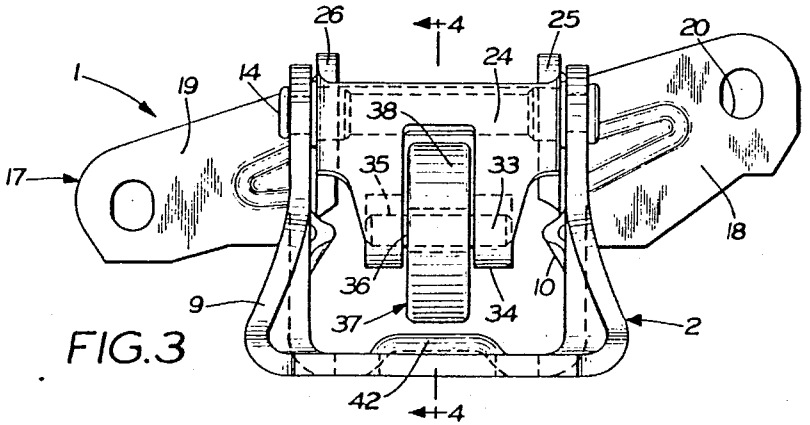
FIG. 3 is an end elevational view looking in the direction of arrows 3—3, FIG. 2.

The improved hinge spring is indicated generally at 1, and is shown in a disassembled state in FIG. 1 and in the closed assembly state in FIGS. 2 and 3. Hinge spring 1 includes as main components a first mounting bracket, indicated generally at 2, which usually will be mounted on a doorway of a vehicle frame when used in such an installation represented by plate 3 in FIGS. 4–6.

Mounting bracket 2 consists of a flat base plate 4 formed with a plurality of mounting holes 5 for securing it to door plate 3 by rivets 6 (FIG. 4) or other attachment means well known in the art. Bracket 2 includes a pair of upstanding side flanges 8 and 9, each of which is formed with an inwardly projecting stop 10 located below a pair of pin mounting holes 11. A pivot pin 13 is adapted to be slidably received in holes 13 and extends between side flanges 8 and 9 and is secured therein by an end rivet 14 which is press fitted into an open end 15 of pin 13.

Figure 4:
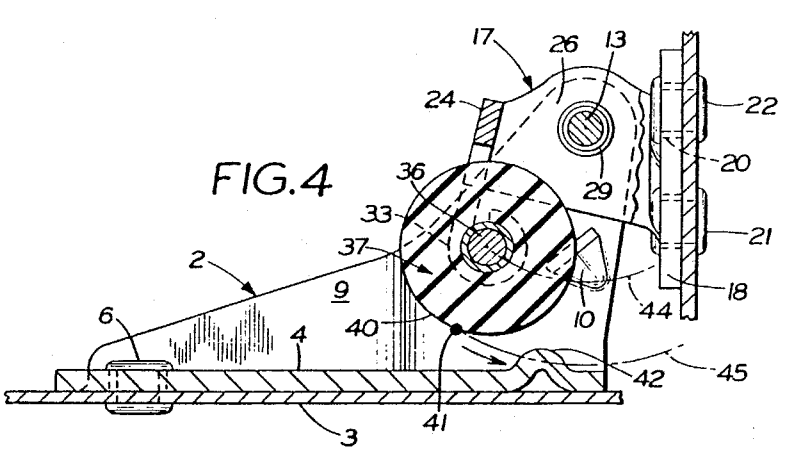
FIG. 4 is a sectional view taken on line 4—4, FIG. 3.
Figure 6:
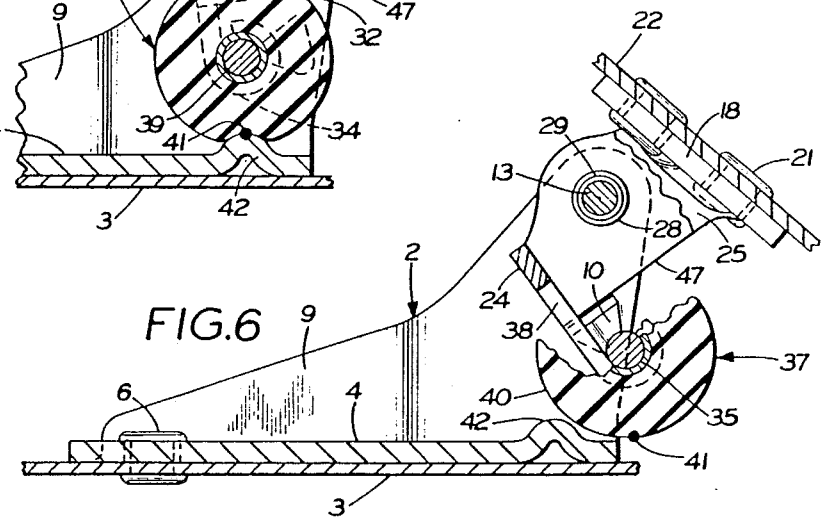
FIG. 6 is a fragmentary sectional view with portions broken away, similar to FIGS. 4 and 5, showing the position of the elastomeric roller with the door in an open position.

A second mounting bracket member, indicated generally at 17, is stamped of sheet metal and has a pair of mounting flanges 18 and 19 each formed with a hole 20, for recieving a rivet 21 or other attachment means for mounting bracket 17 onto a frame of a swinging door, indicated by plate 22 in FIGS. 4 and 6. A pivot support plate 24 is spaced forwardly and generally parallel with the plane of attachment flanges 18 and 19 and is connected integrally thereto by spaced leg portions 25 and 26. Legs 25 and 26 are formed with mounting holes 28 thorugh which pivot pin 13 extends for pivotally mounting plate 17 onto mounting bracket 2 as shown in particularly in FIGS. 2 and 3.

A pair of bearing bushings 29 are telescopically mounted on the ends of pin 13 and located within holes 28 of bracket 17 to provide a bearing surface for the pivotal movement of bracket 17 on pin 13. Annular end flanges 30 of bearing bushings 29 press against the inner surfaces 32 of side flanges 8 and 9 of bracket 2 when assembled therewith.

A pair of downwardly extending tabs 33 are formed on pivot support plate 24 and terminate in rolled ends 34 forming a pair of aligned openings 35 into which a shaft 36 of an elastomeric roller 37 extends, for mounting roller 37 within a space 38 formed between tabs 33 (FIG. 1). Elastomeric roller 37 has an annular shape formed with an axial bore 39 through which shaft 36 extends. Roller 37 further includes a cylindrical end face 40, which in accordance with one of the features of the invention, engages a detent 42 that is stamped in flat base plate 4 of bracket 2 and is located generally between upstanding side flanges 8 and 9.

Figure 5:
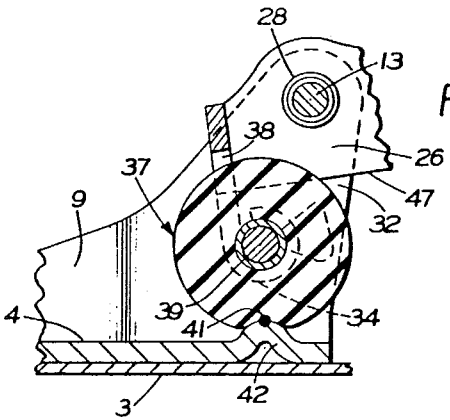
FIG. 5 is a fragmentary sectional view similar to FIG. 4 showing the hinge spring in a generally intermediate position.

The particular relationship and mode of operation of the various component parts discussed above and shown particularly in FIG. 1 are further understood by reference to FIGS. 4, 5, and 6 which show the operation of the improved hinge spring of the invention. FIG. 4 shows the usual position of the various components of hinge spring 1 when the vehicle door is in the closed position. In this position, attachment flanges 18 and 19 of bracket 17 are generally perpendicular to flat base plate 4 of mounting bracket 2 and elastomeric roller 37 will be located generally above and forward of detent 42 which projects upwardly from plate 4 toward the roller.

Upon movement of the door from the closed position of FIG. 4 to the open position of FIG. 6, the centerline of shaft 36 and correspondingly the outer circumference of roller 37 represented by point 41, will follow arcuate paths 44 and 45, respectively, as bracket 2 pivots about pin 13. The centerline of pin 13 is fixed with respect to the vehicle since mounting bracket 2 is mounted on the fixed frame portion of the vehicle, with bracket 2 being mounted on the door thereof.

As can be seen from FIGS. 4–6, the path of travel of roller 37 and in particular point 41 on outer surface 40 thereof, will bring surface 40 into contact with detent 42 causing a temporary compression of the roller as shown in FIG. 5. Upon the door and attached bracket 17 reaching the fully opened position of FIG. 6, outer surface 40 of roller 37 is out of contact with detent 42. Roller 37 will maintain the vehicle door in the open position until sufficient force is applied thereto in the closing direction to compress roller 37 as shown in FIG. 5 upon the roller following the return path from the open position of FIG. 6 back to that of FIG. 4. Roller 37 may be fixed on shaft 36 and in rolled ends 34 or may be rotatably mounted thereon without effecting the concept of the invention.

Upon opening the door, an extra force must be applied to the opening movement of the door to compress roller 37 as it moves across detent 42. This opening force will usually be supplied by the kinetic energy of the swinging door as it nears the full open position and will rarely be noticed by the occupant of the vehicle. However, upon reaching the full open position of FIG. 6, a definite force will be required by the user to move the roller over detent 42 since the door is stationary at the time and will not have the kinetic energy therein as it will upon reaching the end of its opening swinging motion. Also upon reaching the full open position, a forward end of bottom edges 47 of space legs 25 and 26 will abut stops 10 formed in side flanges 8 and 9, providing a positive mechanical stop to the opening movement of hinge spring 1.

Thus, hinge spring 1 provides a simple mechanism, free of any metallic spring components which will maintain the door in the open position requiring an easily adjustable and regulated force to be applied thereto to move the door toward the closed position, yet will not hinder the opening of the door, and which provides a mechanical stop upon the door reaching its full opened position. The vehicle door usually will be provided with main mounting hinges which will support the weight of the door as well as possible other stop mechanisms, than that provided by the engagement of spaced leg edges 47 with stops 10. The particular durometer and physical characteristics of the material forming roller 37 may vary considerably by use of various rubber compositions in order to provide and regulate the amount of force that must be applied to move the door from its open position toward the closed position. Roller 37 preferably is formed of a rubber compound formulated to provide the desired characteristics to withstand the environment of its application. Likewise, the height and position of detent 42 also will determine the amount of force applied to the door to temporarily compress roller 37.

Figure 7:
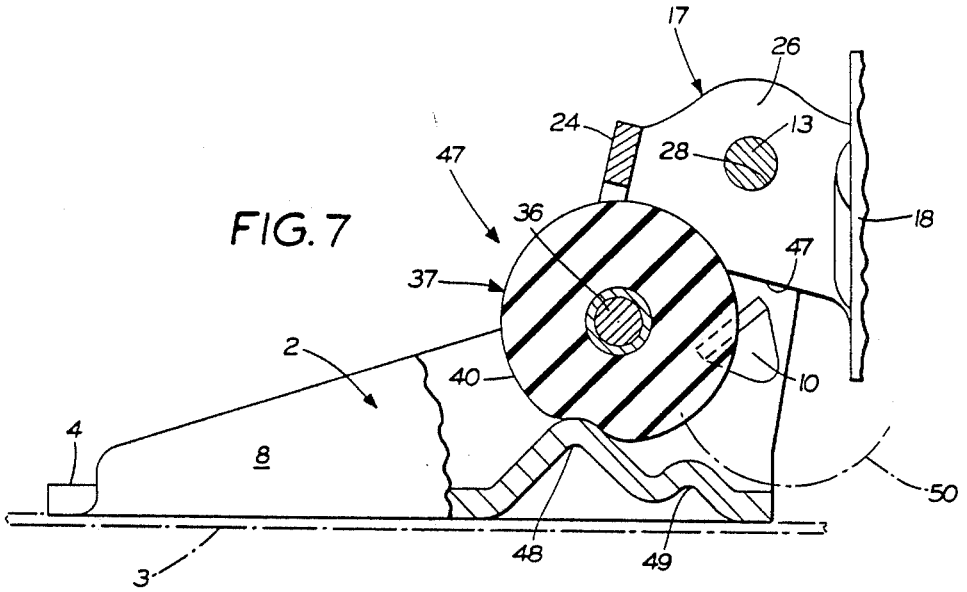
FIG. 7 is a side elevational view with portions broken away and in section, similar to FIG. 4–6, showing a modified embodiment of the hinge spring with a bias being placed on the door when in closed position.

A modified form of the invention is shown in FIG. 7 and is indicated gnerally at 47. In this embodiment a bias is applied to the door when in closed position to provide a slight "pop open" effect thereto upon the door latch being operated. This is accomplished by providing a detent configuration consisting of a detent 48, which when the door is in the closed position, partially compresses roller 37 a desired amount to provide the slight "pop open" effect on the door. A second detent 49 will function in the same manner as detent 42 described above, that is, it will retain the door in the open position, as shown by the position of the roller in dot-dash lines 50. The other features achieved by hinge spring 47 remain the same except that a slight additional force is required at the instant of door latching to partially compress roller 37 against detent 48 as shown in FIG. 7. The remaining components and features of modified hinge spring 47 remain the same as that of hinge spring 1.

Figure 8:
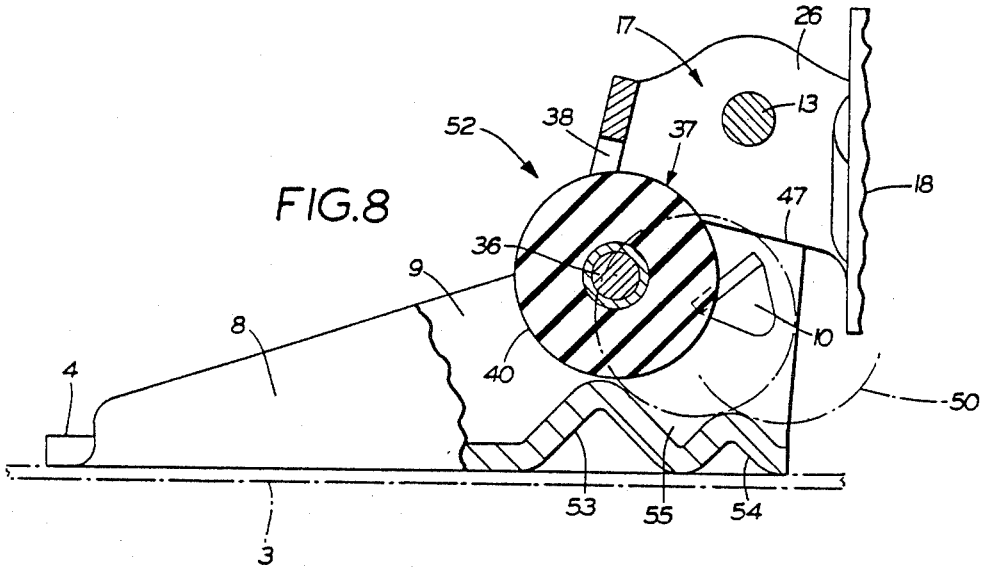
FIG. 8 is a side elevational view with portions broken away and in section, similar to FIG. 7, showing another embodiment of the improved hinge spring having a pair of detents to provide an intermediate position for the roller upon moving between open and closed positions.

A third embodiment of the elastomeric hinge spring is indicated generally at 52 and is shown in FIG. 8. In this embodiment a pair of detents 53 and 54 is formed in plate 4 and will have a height and configuration whereby roller 37 when moving between open and closed position, will also be compressed by detent 53 but will be uncompressed when in valley 55 or the space between the peaks of detents 53 and 54, and also will be temporarily compressed by detent 54. Thus two separate compression locations are provided and an intermediate position, that is, when the roller is located between detents 53 and 54, wherein no compression is exerted on the roller. This provides an intermediate position between the open and closed positions in which the door is retained from movement in either the opening or closing directions by detents 53 and 54. Detent 54 also provides the usual retention of the door in the full open position as does detents 42 and 49 of embodiments 1 and 47.

The remaining components and features of hinge spring 52 generally remain the same as that of hinge spring 1 described in further detail above.

Figure 9:
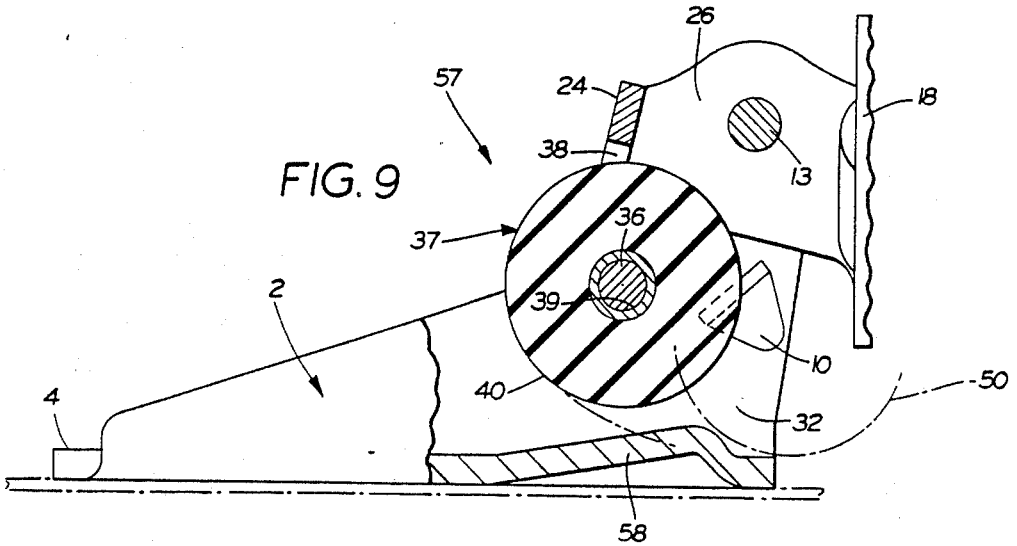
FIG. 9 is another side elevational view with portions broken away and in section, similar to FIGS. 7 and 8, showing a detent in the form of an elongated ramp.

A fourth embodiment of the improved hinge spring is indicated generally at 57, and is shown in FIG. 9. This construction differs from the three embodiments described above in that detent 58 thereof has an elongated ramp configuration instead of the generally V-shaped configuration of detent 42 of embodiment 1. This ramped configuration merely provides different opening and closing characteristics than that provided by detent 42 should various characteristics be required for particular vehicle door mounting arrangements. Again, the remaining components and features of modified hinge spring 57 are the same as that of hinge spring 1.

Accordingly, the improved elastomeric hinge spring is simplified, provides an effective, safe, inexpensive, and efficient device which achieves all the enumerated objectives, provides for elimimating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved elastomeric hinge spring is constructed and used, the characteristics of the construction, and the advantageous, new and useful results obtained; the new and useful structures, devices, elements, arrangements, parts, and combination, are set forth in the appended claims.

What is claimed is:

1. A hinge spring construction for a swinging door including:

(a) a first bracket adapted to be mounted on a frame of a doorway, said first bracket having a generally flat metal base and a pair of spaced upstanding side flanges formed integrally with the base and projecting generally perpendicularly therefrom, said flat base having a longitudinal axis;

(b) a second bracket adapted to be mounted on the door and moveable between open and closed positions; said second bracket having a pair of outwardly projecting spaced legs with a first pin extending therebetween and with an elastomeric roller rotatably mounted on said first pin, said second bracket being pivotally mounted on and between the side flanges by a second pin extending parallel to the base, with said roller being located between the spaced side flanges; and (c) detent means including at least one generally inverted V-shaped projection formed integrally on the base of the first bracket by displacing metal from said base, said detent means projecting outwardly from the base between the spaced side flanges and a plane between the detent means and the second pin being substantially perpendicular to the longitudinal axis of the flat base and projecting into the path of movement followed by the roller upon pivotal movement of the second bracket on the second pin between the open and closed positions so that the roller moves into the plane between the second pin and detent means and through the plane therebetween when moving between the open and closed positions for retaining the second bracket in the open position and for requiring temporary compression of the roller upon movement of the second bracket from the open position toward the closed position.

2. The hinge spring construction defined in claim 1 in which the roller has an annular configuration formed with a central axial bore; and in which the first pin extends through said bore to mount the roller on the pair of legs.

3. The hinge spring construction defined in claim 1 in which a pair of tabs having rolled ends extend from the spaced legs of the second bracket; and in which the first pin is mounted on said rolled ends.

4. The hinge spring construction defined in claim 1 in which the path of movement of the roller is arcuate.

5. The hinge spring construction defined in claim 1 in which the projection is a ramp inclined upwardly in the path of movement of the roller which it follows moving toward the open position.

6. The hinge spring construction defined in claim 1 in which the detent means includes a pair of spaced generally inverted V-shaped projections providing a retained intermediate position for the second bracket when the roller is located between said pair of projections during its path of movement between open and closed positions.

* * * * *